US010863871B2

(12) United States Patent
Coe

(10) Patent No.: US 10,863,871 B2
(45) Date of Patent: Dec. 15, 2020

(54) DRYING METHOD FOR LIMITED MOBILITY INDIVIDUALS

(71) Applicant: Sima Coe, Elkins Park, PA (US)

(72) Inventor: Sima Coe, Elkins Park, PA (US)

(73) Assignee: Sima Coe, Suffern, NY (US)

( * ) Notice: Subject to any disclaimer, the term of this patent is extended or adjusted under 35 U.S.C. 154(b) by 0 days.

(21) Appl. No.: 16/590,711

(22) Filed: Oct. 2, 2019

(65) Prior Publication Data

US 2020/0069117 A1 Mar. 5, 2020

Related U.S. Application Data

(63) Continuation of application No. 16/122,990, filed on Sep. 6, 2018, now Pat. No. 10,470,619.

(60) Provisional application No. 62/555,671, filed on Sep. 8, 2017.

(51) Int. Cl.

| | |
|---|---|
| ***B43L 17/08*** | (2006.01) |
| ***A47K 10/02*** | (2006.01) |
| *A45F 5/04* | (2006.01) |

(52) U.S. Cl.

CPC ..... *A47K 10/02* (2013.01); *A45F 5/04* (2013.01)

(58) Field of Classification Search

CPC ..... A47K 10/02; A45F 5/04; D03D 11/02; F26B 5/16

USPC ..... 34/95.1, 95.2, 95.3, 95.4, 329, 332, 335, 34/336, 397, 95

See application file for complete search history.

(56) References Cited

U.S. PATENT DOCUMENTS

| | | | | |
|---|---|---|---|---|
| 5,390,381 | A * | 2/1995 | LaMantia | A45C 3/10 190/2 |
| 2013/0239290 | A1* | 9/2013 | Rossi | A41D 15/04 2/84 |
| 2017/0273515 | A1* | 9/2017 | Oladeji | A47K 7/022 |
| 2017/0360264 | A1* | 12/2017 | Silverstein | A47K 10/02 |
| 2018/0279844 | A1* | 10/2018 | Montzingo | A41B 13/06 |

* cited by examiner

*Primary Examiner* — John P McCormack
(74) *Attorney, Agent, or Firm* — Weiss & Arons LLP

(57) ABSTRACT

A diagonal strap attached to a towel in embodiments of the disclosed technology allows one to lift a towel upwards to dry their legs without bending down. Handles on the sides of the towel allow one to further dry themselves while leaving their torso substantially in place. These methods of drying allow one with limited mobility to dry his/her body with limited help from others, while being less limited.

21 Claims, 5 Drawing Sheets

DRYING METHOD FOR LIMITED MOBILITY INDIVIDUALS

CROSS-REFERENCE TO OTHER APPLICATIONS

This application is a continuation of U.S. application Ser. No. 16/122,990, filed on Sep. 6, 2018, which is a nonprovisional of U.S. Application No. 62/555,671, filed on Sep. 8, 2017, both of which are hereby incorporated herein in their entireties.

FIELD OF THE DISCLOSED TECHNOLOGY

The disclosed technology relates generally to towels and methods of using same, and more specifically, to a towel with a diagonal for lifting between one's legs.

BACKGROUND

Many people are impaired or partially impaired but still prefer to maintain their dignity by doing as many activities themselves as possible. This includes especially personal hygiene. Among the great many indignities suffered by a mobility impaired person is having to have someone else wash and clean your body, especially those parts of the body which are usually covered and concealed to the outside world.

What is needed is way to help people who have some physical impairment help themselves. As a way to restore dignity, products which allow a person to clean themselves more easily and/or without the aid of another are desired.

SUMMARY OF THE DISCLOSED TECHNOLOGY

A diagonal strap attached to a towel in embodiments of the disclosed technology allows one to lift a towel upwards to dry their legs without bending down. Handles on the sides of the towel allow one to further dry themselves while leaving their torso substantially in place. These methods of drying allow one with limited mobility to dry his/her body with limited help from others, while being less limited.

More specifically, in one embodiment of the disclosed technology, one stands with a foot between a diagonal strap and front side of a towel, the diagonal strap attached to a bottom edge and one of a left edge and right edge of the towel. The diagonal strap is then grasped in a hand and pulled upwards causing the bottom edge of the towel to also be pulled upwards. The towel can now be used, without or with less bending down, to dry the legs such as the inside (medial) sides of the legs, groin, and around the outer sides and back/front sides of the leg(s).

By way of communication with another or by way of direct action thereon, a position where the diagonal strap is attached to the left edge or right edge of the towel can be changed in embodiments of the disclosed technology. Such a change in position of the upper attachment (relative to the ground) of the diagonal strap can be to a height of a waist of a user of the towel or lowest reasonable height where the user can grab the strap. One can also grasp a handle connected to one of the left edge and/or right edge and pull the handle to dry at least part of his or her torso.

A highest height of the diagonal strap, when the towel extends downwards in a substantially planar manner (e.g. hangs down from the top side substantially in parallel to a vertical direction), is substantially a waist height of a person using the towel in some embodiments, or it can be a lowest height that the person can reach.

In some embodiments, the diagonal strap terminates at a pin, the pin movable vertically within a track. Friction within the track where the pin so moves up and down causes the pin to remain at a height above a bottom end of the vertically extending track. When the towel is hung, via hooks or other connecting mechanisms such that the towel hangs downwards from it's top edge, it hangs from a vertical support apparatus.

The towel itself, in embodiments of the disclosed technology, has a front side, a back side, a top edge, a bottom edge, a left edge, and a right edge. A diagonal strap extends from the bottom edge to a middle of a side edge thereof. The "middle" is half way between the top edge and the bottom edge or substantially as such in some embodiments of the disclosed technology. In others, the "middle" is lower than the half way point and/or can be a waist height of the intended user of the towel.

The diagonal strap, in some embodiments of the disclosed technology, is movable from the middle to a position lower than the middle by way of sliding a pin (a device made of a different material than the strap and connected there-to which further connects to the towel by way of friction or fitting within a slot within the towel), grommet, or clip. The pin grommet or clip or other attachment mechanism is connected to the diagonal strap and is movable towards the bottom edge of the towel, along the left or right edge of the towel. In embodiments, the pin remains in position after the sliding by way of friction between the pin and the track. Handles can also be connected to each of a left side and right side of the towel.

A connector can be adapted to hang the towel from a top edge thereof. The towel is hung from the top edge such that the front side is substantially planar (to itself, e.g. sitting in a single two dimensional plane) and the bottom edge is substantially parallel to the ground.

"Substantially" and "substantially shown," for purposes of this specification, are defined as "at least 90%," or as otherwise indicated. Any device may "comprise" or "consist of" the devices mentioned there-in, as limited by the claims.

It should be understood that the use of "and/or" is defined inclusively such that the term "a and/or b" should be read to include the sets: "a and b," "a or b," "a," "b."

DETAILED DESCRIPTION OF EMBODIMENTS OF THE DISCLOSED TECHNOLOGY

The blanket or towel is a flexible fabric sheet which is hung such that it hangs down from a top side or portion which is attached to a wall, towel rack, curtain rod, clips, or the like. The sides each have, in an embodiment of the disclosure, a handle to help grab the sides of the towel to pull the sides inward. A diagonal, a strip of fabric attached to a side of the towel and a bottom side of the towel, is also used in embodiments of the disclosed technology. The diagonal is, in embodiments, grasped and pulled upwards to dry between the legs.

Embodiments of the disclosed technology will become clearer in view of the following discussion of the figures.

Figure 1:
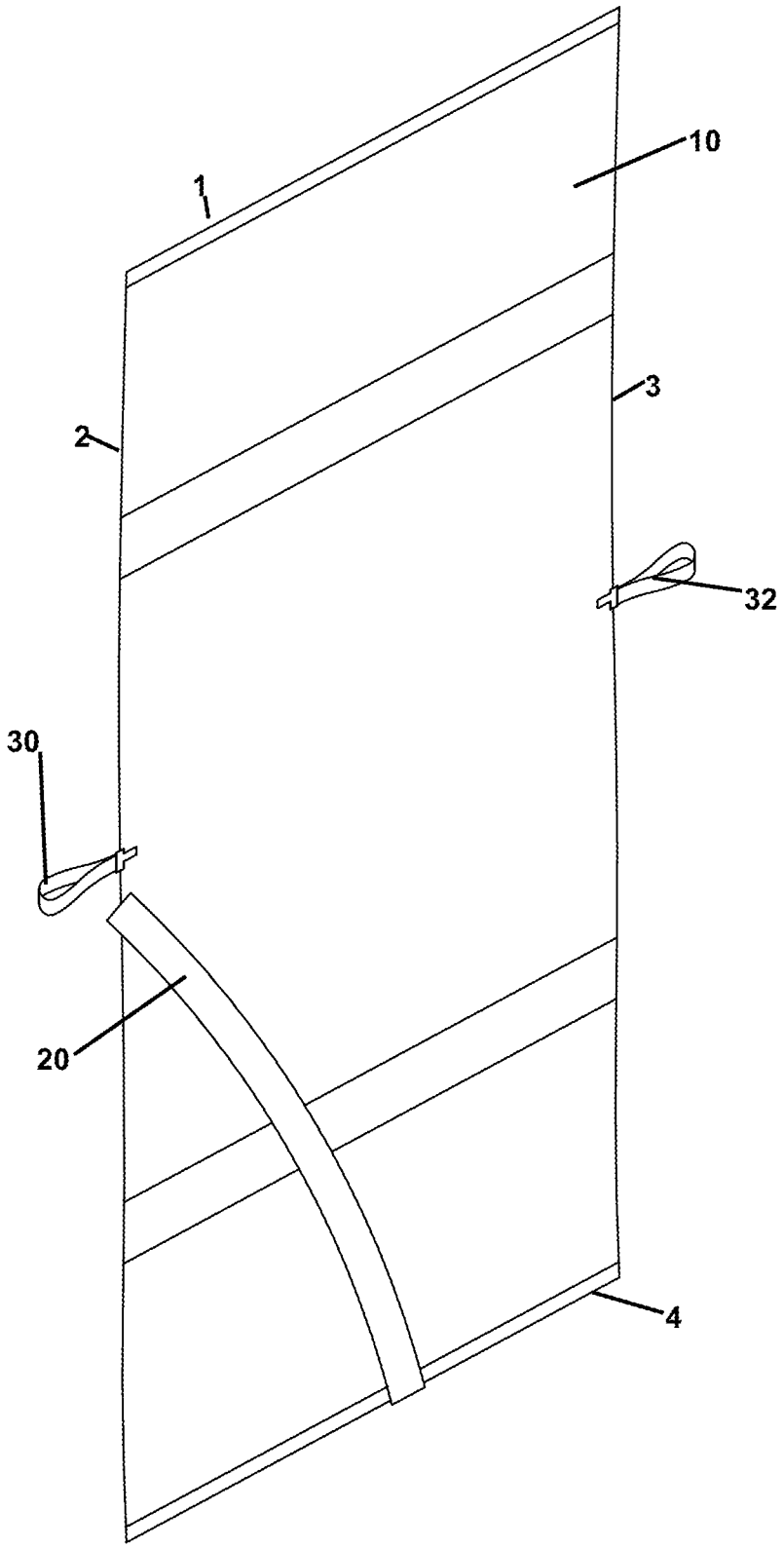
FIG. 1 shows a perspective view of a towel with a diagonal strap, in an embodiment of the disclosed technology.

FIG. 1 shows a perspective view of a towel with a diagonal strap, in an embodiment of the disclosed technology. The towel has a top edge 1, bottom edge 4, left edge 2, right edge 3, front side 10, and back side 12 (numbered in FIG. 2). The front and back sides 10 and 12 are generally elongated and flat but foldable and bendable. One sees substantially the entirety of the front side in FIG. 1 (the diagonal strap 20 and a part of the side handles 30 and 32 slightly block the view). The top edge 1 is opposite the bottom edge 4. The left edge 2 is opposite the right edge 3. A "side" for purposes of this disclosure is an elongated and flat but foldable and bendable planar surface when the side is flattened. An "edge" is a narrow region between two sides.

Thus, a left handle 30 is on the left edge and a right handle 32 is on the right edge or near the respective edges 2 and 3, in embodiments of the disclosed technology. "Near" for purposes of this disclosure is "no more than 20% of the distance from edge to opposite edge". The handle or handles can have padded interiors or non-slip interiors. A "non-slip" interior is one in which has a coefficient of friction at least 20% or 40% higher than one or both of the fabric of the elongated flat front side of the towel or outer side of the handle. Further, a diagonal strap 20 refers to a diagonal piece of fabric or other flexible and bendable material which extends between a side edge 2 (or near a side edge) and a bottom edge 4 (or near a bottom edge) of the front of the towel 10. The diagonal, in some embodiments, extends from a midpoint of the bottom edge 4, or near the midpoint of the bottom edge, to one of the left 2 or right 3 edges or near same. The diagonal strap 20 extends, in some embodiments to substantially a waist height of a user, average user, and/or anticipated average user of the towel. The diagonal can attach to a front or back side of the towel and can be attached at 50% of the distance between a top and bottom edge, or in embodiments, lower such as at 45% or 40% in order to accommodate such that it is within reaching distance of a user of the towel and substantially at waist height or a height between a groin area and belly button.

Figure 2:
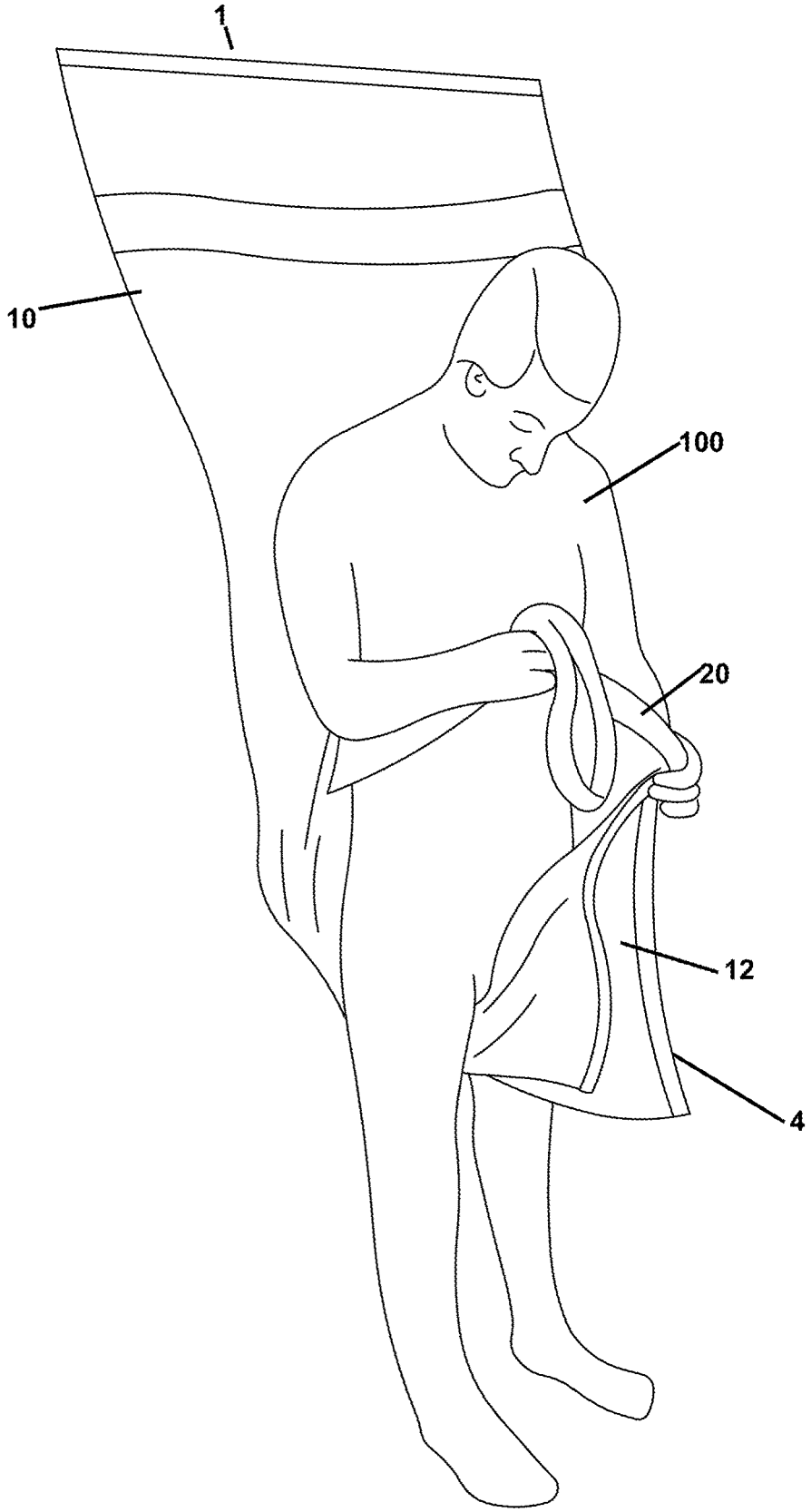
FIG. 2 shows a version of the towel of FIG. 1 with the towel lifted between one's legs by way of the diagonal strap, in an embodiment of the disclosed technology.

FIG. 2 shows a version of the towel of FIG. 1 with the towel lifted between one's legs (the inside sides of the legs and groin area) by way of a diagonal, in an embodiment of the disclosed technology. Here, the person 100 grabs the diagonal strap 20 and pulls it upwards. In this manner, a person who has limited mobility and cannot bend down due to back or other problems can pull the bottom edge 4 of the towel 10 upwards by reaching for the diagonal strap 20, which is within reach of one's hand while standing in front of the towel. Then one pulls, such as hand over hand, along the length of the diagonal strap 20, causing the bottom edge 4 of the towel to move upwards until it is within reach. Then one can grab the bottom edge 4 of the towel 10. Before doing so, one, in embodiments of the disclosed technology, one steps or places one's feet on either side of the bottom edge of the towel such that the diagonal strap 20 is between the feet or adjacent to an inside side of a foot (such as a person with one foot). In the process of pulling the towel upwards, the towel can be rubbed along the inside sides of the legs and/or wrapped around or against the sides of the legs. In this manner, one can dry their legs without bending down.

Figure 3:
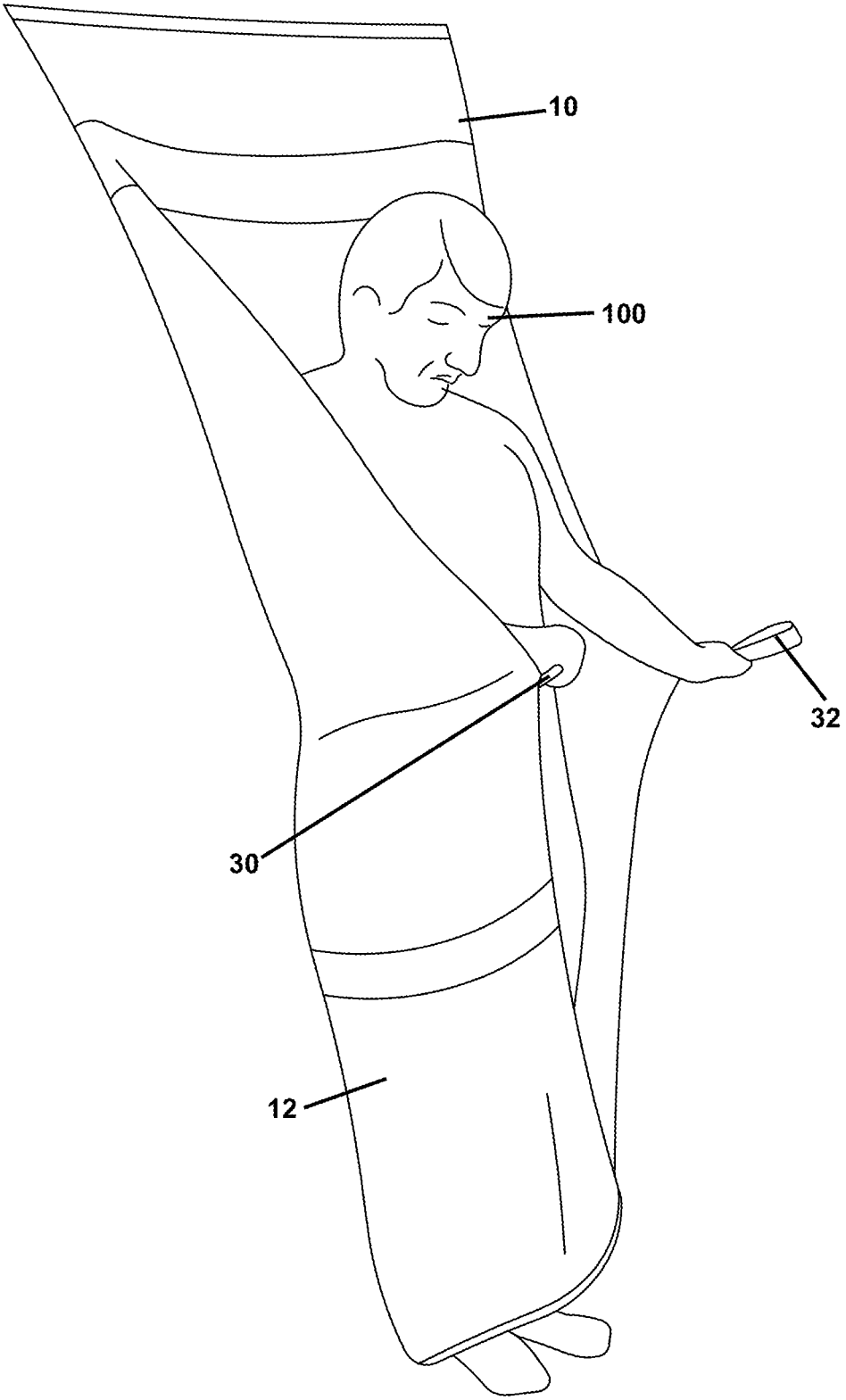
FIG. 3 shows a version of the towel of FIG. 1 with side handles pulled inwards, in an embodiment of the disclosed technology.

FIG. 3 shows a version of the towel of FIG. 1 with side handles pulled inwards, in an embodiment of the disclosed technology. The side handles 30 and 32 are, in embodiments, midway between the top edge 1 and bottom edge 4, aligned to a waist of a person 100 who will use the device, and/or up to 5%, 10%, or 20% offset from the midway point and/or waist depending on the embodiment of the disclosed technology. Each handle 30 and 32 allows a person, especially one with limited mobility, to pull a respective side edge of a towel towards their body. The handles are at hand height or higher in embodiments of the disclosed technology. In embodiments, the handles are between the height of a user's finger tips when one rests their arms and hand at their side, and the height of one's forearm or elbow. In this manner, they are easily graspable without having to move one's body (except for forearm or hand) in order to pull the side edges, and thereby some of the front side of the towel, around the front of a person for warmth or drying of one's body.

Thus, one can use the towel 10 to dry between their legs (the medial sides) and on the outside (lateral/distal sides) of their legs and torso using a combination of the diagonal strap 20, side handles 30/32, and their hands. This can be done without bending over/bending the back so that a person with back problems or other limited mobility problems can dry themselves using such towel which is hung from a vertical support.

Figure 4:
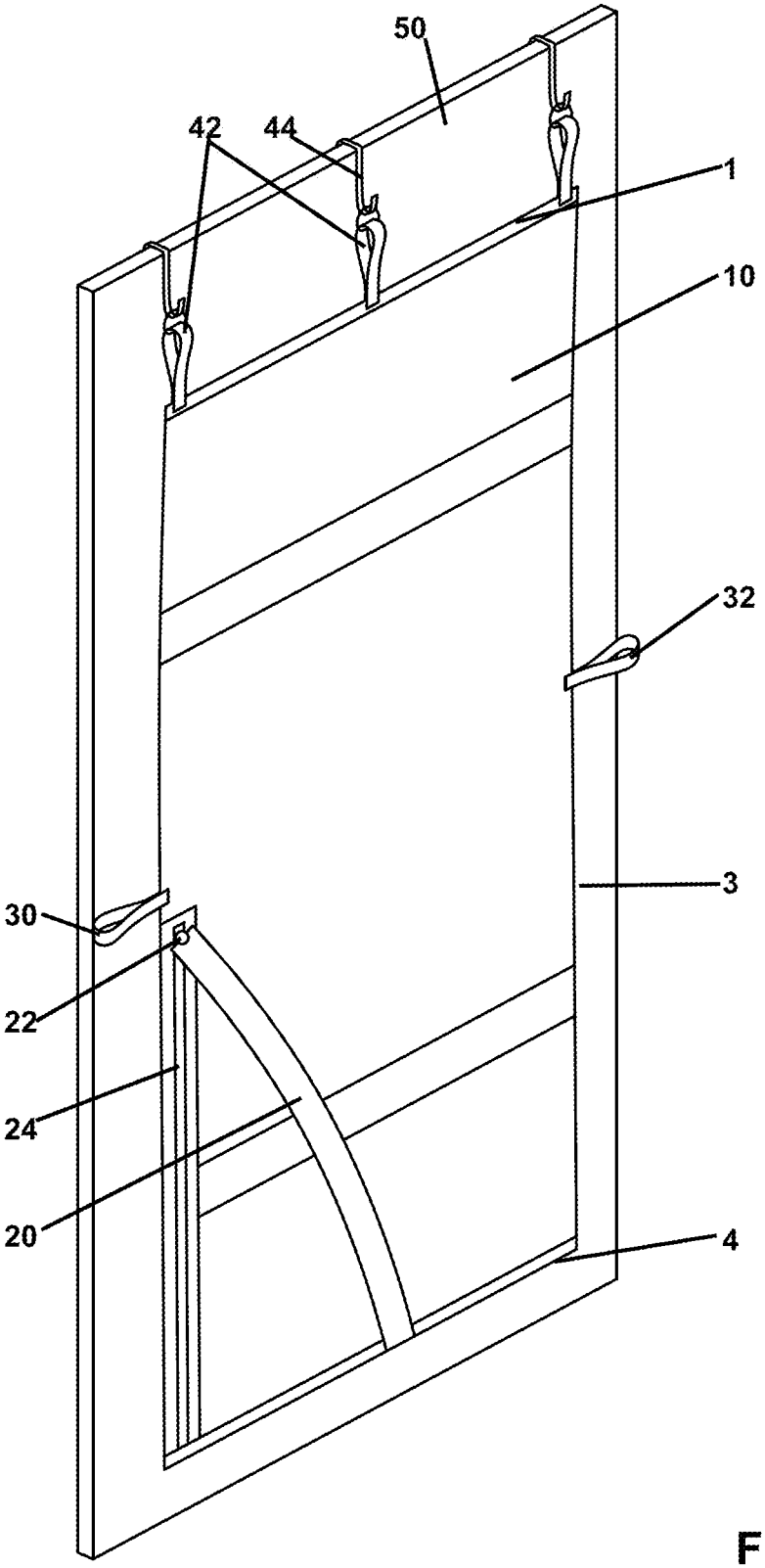
FIG. 4 shows a towel attached to a vertical support member and having a movable end of a diagonal strap in an embodiment of the disclosed technology.

FIG. 4 shows a towel attached to a vertical support member and having a movable end of a diagonal strap in an embodiment of the disclosed technology. Here, the vertical support 50 is a wall, door, or other fixture or support which is held in place relative to a ground there-beneath which a person using the towel 10 steps on (directly or indirectly via a mat or the like on the ground). "Steps on" is defined as "having one's foot or feet above an item such that pressure/force from one's foot or feet pushes in a direction towards the object being stepped on." The vertical support has hooks or hanging mechanisms 42 attached to straps 44 which support the upper edge 1 of the towel 10. The towel's back side 12, while touching the vertical support 50 in various places at some times, is only attached, in the embodiment shown, along the top edge 1 to devices which indirectly or directly attach the towel 10 to the vertical support 50.

Further, the towel of embodiments of the disclosed technology has a slidable diagonal strap 20. The diagonal strap 20, in this embodiment, is fixed in position at the lower edge 4 of the towel but movable/adjustable along the left edge 2 of the towel. The movement can be via a pin or connector 22 attached to an end of the strap which slides within a track 24, having various "stops" which prevent the pin 22 from moving further downwards without the exertion of force beyond gravitational pull, such as at least 2, 3, or 5 times the pull of gravity. As such, one can lift the end of the strap 20 upwards to the top or towards the top of the track 24 where the pin 22 will frictionally remain in place unless pulled downwards by a person exerting a force in the downwards direction (or the equivalent force provided by a mechanical device). In this manner, the diagonal strap 20 will, in embodiments of the disclosed technology, stay where it is left to rest and can be adjusted such that its height is the best height for a user thereof, e.g. the diagonal strap 20 extends as high up as the lowest that a person/user using the towel 10 can reach without pain or can reach while standing erect/at a normal standing height for the person.

Figure 5:
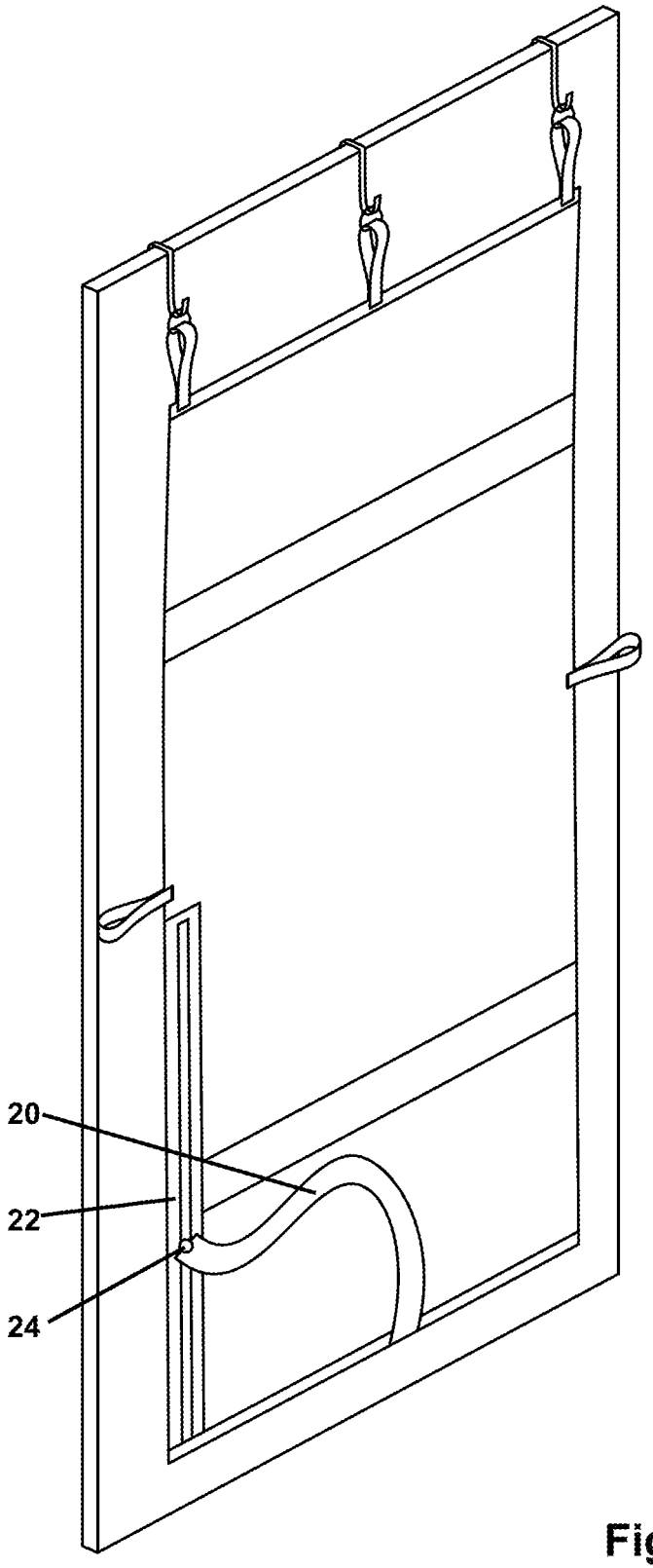
FIG. 5 shows the towel of FIG. 4 with the diagonal strap lowered along the side of the towel in an embodiment of the disclosed technology.

FIG. 5 shows the towel of FIG. 4 with the diagonal strap lowered along the side of the towel in an embodiment of the disclosed technology. Here, the strap 20 has been lowered which allows a greater area under the strap and for some users is easier to use because they may, for example, have enough mobility of their back to bend to a lower height (such as half way or less up the slider 22, which is ¼ or less up the towel side edges 2 and 3) but less mobility of their leg or legs. Their leg is placed under the strap while the other leg is on the other side, outside of the area bound at an upper side by the strap. One may then either pull up the towel 10 by the strap 20 or pull up the strap by the pin 24, moving up the slider 22, and then pull up the towel to dry their inner legs.

Therefore, by using the diagonal and the side handles, and rubbing the towel and one's body against one another while moving one relative to the other, one is able to dry the insides of their legs, outsides of the legs, arms, and torso.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A method of using a towel, comprising the steps of:

standing with a foot upon a surface, with an at least partially upright back oriented toward a front side of a towel, said foot disposed between a diagonal strap and said front side, said diagonal strap attached to a bottom edge of said towel and to one of a left edge and a right edge of said towel;

grasping said diagonal strap with a hand while standing and maintaining said foot upon said surface and maintaining said back at least partially upright;

pulling said diagonal strap upwards; and using said towel to dry at least a part of a leg from which said foot extends.

2. The method of claim 1, further comprising, before the step of standing, a step of inserting said foot downward through a region bounded by said front side and said diagonal strap, said region larger in a cross-section than a widest cross-section of said foot.

3. The method of claim 1, further comprising a step of grasping a handle connected to one of said left edge and said right edge and pulling with said handle to dry at least a part of a torso.

4. The method of claim 1, wherein a highest height of said diagonal strap, when said towel extends downwards in a substantially planar manner, is substantially a waist height of a person carrying out said method.

5. The method of claim 1, wherein the step of pulling is executed, at least in part, via said hand.

6. The method of claim 1, wherein the step of pulling raises said bottom edge alongside a medial aspect of said leg.

7. The method of claim 1, wherein said towel is hung, via connecting mechanisms along a top edge of said towel, from a vertical support before said step of standing.

8. The method of claim 7, wherein said towel is hung such that said bottom edge is within said foot's mid-ankle-height from said surface.

9. A towel comprising:

a front side, a back side, a top edge, a bottom edge, a left edge, and a right edge; and a diagonal strap extending from said bottom edge to a middle of a side edge thereof;

wherein said middle is between about 25% and about 50% of the way up, along said side edge, from said bottom edge to said top edge.

10. The towel of claim 9, wherein said middle is half way, along said side edge, between said top edge and said bottom edge.

11. The towel of claim 9, wherein, when said towel extends downward from said top edge, with said front side extending substantially vertically planar, said middle is substantially a waist height of an intended user of said towel.

12. The towel of claim 9, wherein, when said towel extends downward from said top edge, with said front side being substantially vertically planar, said middle is a height an intended user of said towel can comfortably reach down to while standing at least partially erect in front of said towel.

13. The towel of claim 9, wherein a position of attachment of said diagonal strap at said middle is adjustable between about 25% and about 50% of the way up, along said side edge, from said bottom edge to said top edge.

14. The towel of claim 9, further comprising a handle connected to one of a left side and right side of said towel.

15. The towel of claim 9, further comprising a connector adapted to hang said towel from said top edge thereof.

16. The towel of claim 15, wherein said towel is hung from said top edge such that said front side is substantially planar and said bottom edge is substantially parallel to the ground.

17. A method of using a towel, comprising the steps of:

with a back of a user at least partially erect and said back oriented toward a front side of a towel, disposing a foot of said user between a diagonal strap and said front side, said diagonal strap attached to a bottom edge of said towel and to one of a left edge and a right edge of said towel, said disposed foot being substantially closer to a position of attachment of said diagonal strap to said bottom edge than to a position of attachment of said diagonal strap to said one of said left edge and said right edge;

while maintaining said foot as disposed and while maintaining said back at least partially erect, grasping said diagonal strap with a hand of said user;

pulling said diagonal strap upwards; and using said towel to dry at least a part of a leg from which said foot extends.

18. The method of claim 17, wherein:

the step of disposing precedes the step of grasping; and the step of grasping precedes the step of pulling.

19. The method of claim 17, wherein the step of pulling is executed, at least in part, via said hand.

20. The method of claim 17, wherein the step of pulling raises said bottom edge alongside a medial aspect of said leg.

21. The method of claim 17, wherein an area of said front side substantially commensurate with a total area of said at least partially erect back is disposed substantially vertically planar facing said at least partially erect back.

* * * * *